US010539006B2

(12) United States Patent
Hess et al.

(10) Patent No.: US 10,539,006 B2
(45) Date of Patent: Jan. 21, 2020

(54) RARE EARTH ALLOYS AS BOREHOLE MARKERS

(71) Applicant: HALLIBURTON ENERGY SERVICES, INC., Houston, TX (US)

(72) Inventors: Joe Eli Hess, Richmond, TX (US); Andrew Cuthbert, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 131 days.

(21) Appl. No.: 15/328,830

(22) PCT Filed: Sep. 11, 2014

(86) PCT No.: PCT/US2014/055158
§ 371 (c)(1),
(2) Date: Jan. 24, 2017

(87) PCT Pub. No.: WO2016/039755
PCT Pub. Date: Mar. 17, 2016

(65) Prior Publication Data
US 2017/0211374 A1 Jul. 27, 2017

(51) Int. Cl.
*E21B 47/09* (2012.01)
*E21B 7/06* (2006.01)
*E21B 17/14* (2006.01)

(52) U.S. Cl.
CPC ..... *E21B 47/0905* (2013.01); *E21B 7/06* (2013.01); *E21B 17/14* (2013.01)

(58) Field of Classification Search
CPC ..... E21B 47/04; E21B 47/0905; E21B 17/14; E21B 7/06; E21B 33/14; E21B 47/0001;
(Continued)

(56) References Cited

U.S. PATENT DOCUMENTS 2,228,623 A * 1/1941 Ennis ..... E21B 43/119 102/313
3,106,960 A * 10/1963 Doak ..... E21B 47/09 166/64

(Continued)

FOREIGN PATENT DOCUMENTS

WO 2014/044628 3/2014

OTHER PUBLICATIONS

"Magnetic tape", downloaded May 15, 2019, https://en.wikipedia.org/wiki/Magnetic_tape, 4 pages (Year: 2019).*

(Continued)

*Primary Examiner* — Jennifer H Gay
(74) *Attorney, Agent, or Firm* — Gilliam IP PLLC

(57) ABSTRACT

A magnetic marking method includes drilling a borehole and marking a position along an uncased section of the borehole with a magnetic marker comprising a magnetic rare earth alloy. A magnetic marker for open hole use includes an unconsolidated mass of high remanence, magnetized material that comprises a magnetic rare earth alloy. The magnetic marker for open hole use also includes a suspension fluid suited for conveying the magnetized material through a drill string bore into an open borehole. A magnetic marker for a casing terminus includes a magnet comprising a magnetic rare earth alloy and an attachment mechanism that secures the magnet to a casing shoe. Such magnetic markers for open hole use or a casing terminus can be used for borehole intersection operations.

23 Claims, 9 Drawing Sheets

(58) Field of Classification Search
CPC ..... E21B 47/0006; E21B 47/0005; E21B 47/065; E21B 47/12; E21B 47/122; E21B 33/0355; E21B 33/035; E21B 43/01
See application file for complete search history.

(56) References Cited

U.S. PATENT DOCUMENTS 3,513,912 A * 5/1970 Boop ..... E21B 43/119 166/66.5
3,637,033 A * 1/1972 Mayall ..... E21B 17/00 166/66.5
3,843,923 A * 10/1974 deVries ..... E21B 41/0014 166/66
4,222,444 A * 9/1980 Hamilton ..... C09K 8/035 166/253.1
4,244,424 A * 1/1981 Talbot ..... H01F 7/0215 166/66
4,572,293 A * 2/1986 Wilson ..... E21B 47/0905 166/250.01
4,700,142 A * 10/1987 Kuckes ..... G01V 3/26 166/66.5
4,791,373 A * 12/1988 Kuckes ..... G01V 3/26 166/66.5
5,064,006 A * 11/1991 Waters ..... E21B 7/068 175/45
5,103,920 A * 4/1992 Patton ..... E21B 47/02216 175/45
5,218,301 A * 6/1993 Kuckes ..... E21B 47/02 324/207.26
5,323,856 A * 6/1994 Davis ..... E21B 47/0905 166/253.1
5,544,705 A * 8/1996 Jones ..... E21B 27/02 166/250.04
6,230,799 B1 5/2001 Slaughter et al.
6,563,303 B1 * 5/2003 Watkins ..... E21B 47/04 324/206
7,474,221 B2 * 1/2009 Den Boer ..... E21B 17/006 340/572.8
7,698,922 B1 * 4/2010 Danko ..... B21K 1/74 219/121.85
8,573,297 B2 11/2013 Tomberlin et al.
9,932,819 B2 * 4/2018 Blange ..... E21B 47/02216
2002/0195276 A1 * 12/2002 Dubinsky ..... E21B 44/005 175/40
2006/0087448 A1 * 4/2006 Den Boer ..... E21B 17/006 340/854.2
2008/0041626 A1 * 2/2008 Clark ..... G01V 3/26 175/45
2010/0243325 A1 * 9/2010 Veeningen ..... E21B 17/028 175/40
2010/0326660 A1 * 12/2010 Ballard ..... C08G 59/5006 166/300
2011/0056703 A1 * 3/2011 Eriksen ..... E21B 7/20 166/381
2012/0067577 A1 * 3/2012 Roddy ..... C04B 40/0641 166/292
2012/0067580 A1 * 3/2012 Parsche ..... E21B 43/2401 166/302
2012/0138291 A1 * 6/2012 Tomberlin ..... E21B 47/026 166/254.2
2012/0139530 A1 * 6/2012 McElhinney ..... E21B 47/02216 324/207.13
2012/0193144 A1 * 8/2012 Hallundbæk et al. .... E21B 7/04 175/45
2012/0234533 A1 * 9/2012 Chen ..... E21B 47/082 166/250.01
2012/0325490 A1 * 12/2012 Ohta ..... E21B 33/035 166/363
2013/0173164 A1 * 7/2013 Zhang ..... G01V 3/28 702/6
2014/0121971 A1 * 5/2014 Hanak ..... E21B 47/02216 702/6
2015/0041117 A1 * 2/2015 Schlembach ..... E21B 47/0905 166/113
2015/0099104 A1 * 4/2015 Liang ..... B22F 3/12 428/220
2015/0240623 A1 * 8/2015 Blange ..... E21B 7/04 166/250.01
2016/0010424 A1 * 1/2016 van Oort ..... C04B 28/02 166/293
2016/0041294 A1 * 2/2016 Wu ..... E21B 33/13 324/338
2016/0046853 A1 * 2/2016 Chatterji ..... C09K 8/426 166/292
2016/0194951 A1 * 7/2016 Hay ..... E21B 47/0905 175/24
2017/0211374 A1 * 7/2017 Hess ..... E21B 47/04
2017/0248006 A1 * 8/2017 Hess ..... E21B 43/17
2018/0010438 A1 * 1/2018 Ravi ..... E21B 47/0005
2018/0017697 A1 * 1/2018 Fouda ..... E21B 47/123
2018/0094519 A1 * 4/2018 Stephens ..... E21B 47/0001
2018/0155605 A1 * 6/2018 Chatterji ..... E21B 21/003
2018/0188407 A1 * 7/2018 Roberson ..... G01V 3/30
2018/0238168 A1 * 8/2018 Roberson ..... C04B 28/02
2018/0252093 A1 * 9/2018 Cramm ..... E21B 47/102

OTHER PUBLICATIONS

PCT International Search Report and Written Opinion, dated Sep. 11, 2014, Appl No. PCT/US2014/055158, "Rare Earth Alloys as Borehole Markers," Filed Sep. 11, 2014, 12 pgs.
PCT International Preliminary Report on Patentability, dated Mar. 7, 2016, Appl No. PCT/US2014/055158, "Rare Earth Alloys as Borehole Markers," Filed Sep. 11, 2014, 6 pgs.
PCT Written Opinion of International Preliminary Examining Authority, dated Nov. 30, 2015, Appl No. PCT/US2014/055158, "Rare Earth Alloys as Borehole Markers," Filed Sep. 11, 2014, 4 pgs.
GCC Examination Report; Application Serial No. GC 2015-29823 ; dated Dec. 13, 2017, 5 pages.
Canadian Application Serial No. 2,958,048, Canadian Office Action; dated Apr. 5, 2018, 6 pages.
Singapore Application serial No. 11201701017R; SG First Written Opinion; dated Mar. 14, 2018; 6 pages.
Australian Application Serial No. 2014405923, Examination Report No. 1, dated Oct. 5, 2017, 3 pgs.
Canadian Application Serial No. 2,958,048; Office Action; dated Dec. 19, 2018, 5 pages.

* cited by examiner

RARE EARTH ALLOYS AS BOREHOLE MARKERS

BACKGROUND

Much effort has been invested in techniques for accurately tracking and drilling boreholes in position relative to existing boreholes. Many such techniques rely on the conductivity or ferromagnetism of steel tubing in the reference borehole, yet such techniques are not applicable to open (uncased) boreholes, which may be where an intervention is most needed.

Before a borehole can be cased, it must be drilled. It is during the drilling process itself when the results of pressure differential, such as hydrocarbon kicks or blowouts, occur. In many cases, the pressure differential is so severe that the operator may drill a relief well. A relief well may intersect the initial borehole and be used in order to inject a dense "kill" fluid that suppresses further influx of formation fluid into the original borehole. Relief wells may intersect a target borehole below the differential influx depth, or at least as close to the deepest point of the borehole as practicable, but open boreholes cannot be located with existing techniques that rely on the material properties of casing.

BRIEF DESCRIPTION OF THE DRAWINGS

Accordingly, there are disclosed in the drawings and the following description use of magnetic rare earth alloy markers to mark the terminus of a casing string and/or selected positions along an uncased section of a borehole. In the drawings.

Figure 1:
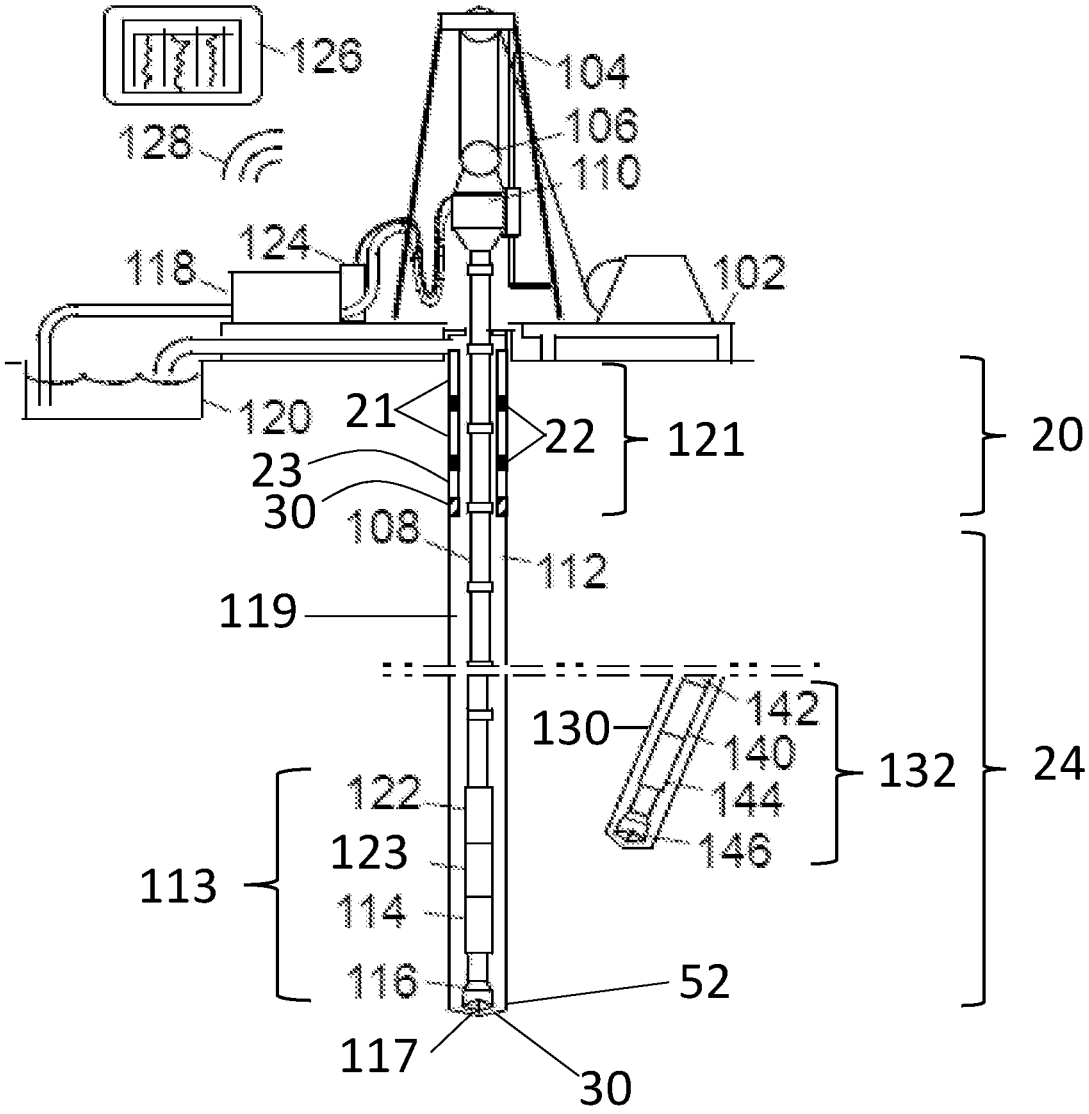
FIG. 1 is a schematic view of an illustrative drilling environment.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

The ranging obstacles outlined above are at least in part addressed by deploying one or more magnetic rare earth alloy markers in a borehole to identify the casing terminus and/or one or more positions in an uncased section beyond the casing terminus, including a borehole terminus. The term "casing terminus" refers to where the casing ends and may be associated with a point along or near the last casing section. The last casing section may be the lowest casing section (e.g., along a vertical borehole trajectory) or may simply be the casing section that extends farthest into a borehole (e.g., along a horizontal borehole trajectory). Meanwhile, the term "borehole terminus" refers to the end of the borehole. As boreholes can extend in different directions, the end of a given borehole may be the lowest point of the given borehole or may simply be where the given borehole ends.

As described herein, one or more magnetic rare earth alloy markers may be deployed in a borehole before or after a pressure differential is encountered. Once deployed, the one or more magnetic rare earth alloy markers facilitate passive ranging operations that guide a relief well to a position along the uncased section of the borehole (beyond the casing terminus), which may be a position at or near the pressure differential. In some embodiments, use of one or more magnetic rare earth alloy markers in a borehole as described herein can be combined with other ranging techniques such as ranging based on the metal conductivity or ferromagnetism of a casing. Further, with one or more magnetic rare earth alloy markers deployed in a borehole as described herein, obstacles to active ranging (e.g., how to convey power to a marker in the borehole) are avoided.

In at least some embodiments, the proposed magnetic markers may be deployed at the casing terminus (e.g., on a casing shoe), thereby marking where the casing ends and the open borehole begins. Such deployment may result in the magnetic markers being cemented in place during normal casing cementing operations. As an example, one or more magnetic markers may be permanently attached to a casing shoe prior to lowering the casing shoe into the borehole. Such attachment may be made by any manner including embedding the magnetic marker into recesses formed in the casing shoe or attaching a strap containing one or more magnetic markers to the exterior of the casing shoe. The permanent placement of the high-residual-magnetism markers ensures that a high energy source of magnetism is present to enhance the ability to detect the bottom of the casing string over time.

In at least some of the embodiments described further below, relief well operations involve drilling a borehole down to a planned kickoff point and then turning the relief well towards a target borehole containing one or more magnetic rare earth alloy markers and experiencing a pressure differential. With the one or more magnetic rare earth alloy markers in the target borehole and passive ranging tools in the relief well, the relief well is extended until it intersects the target borehole at a desired position relative to the one or more magnetic rare earth alloy markers. The intersection position relative to the one or more magnetic rare earth alloy markers may be determined, for example, using predetermined information regarding the total depth of the target borehole, the length of one or more cased sections in the target borehole, the length of an uncased section in the target borehole, the estimated location of the pressure differential relative to the borehole terminus, the length of a cased section of the target borehole, and/or an absolute (coordinate) position. Once the relief well intersects the target borehole at the desired position, the pressure differential can be handled using known "kill" techniques. Various options for magnetic rare earth alloy markers and their deployment in a borehole are disclosed herein.

The disclosed magnetic rare earth alloy marker options are best understood in an application context. FIG. 1 shows a schematic view of one illustrative drilling environment. Other suitable drilling environments include such scenarios as: drilling with casing, drilling with continuous tubing, drilling from an offshore platform, extended-reach drilling, and unconventional drilling methods. A drilling platform 102 supports a derrick 104 having a traveling block 106 for raising and lowering a drill string 108. A top drive 110 supports and rotates the drill string 108 as it is lowered into a borehole 112. The drill string 108 includes a bottom-hole assembly (BHA) 113 comprised of a control sub 122, a survey tool 123, a downhole motor assembly 114, and a drill bit 116. The drill bit 116 includes one or more orifices 117 to allow fluids to pass from the interior of the drill string 108 to the borehole terminus 52 of borehole 112. As the drill string 108 and/or drill bit 116 rotates, the borehole 112 is extended through various subsurface formations (not shown). In at least some embodiments, the BHA 113 includes a rotary steerable system (RSS) or other steering mechanism that enables the drilling crew to steer the drill bit 116 along a desired path. While drilling, a pump 118 circulates drilling fluid through a feed pipe to the top drive 110, downhole through the interior of drill string 108, through at least one orifice 117 in the drill bit 116, back to the surface via a region between the drill string 108 and the borehole 112, otherwise known as an annulus 119, and into a retention pit 120. The drilling fluid transports cuttings from the borehole into the retention pit 120 and aids in maintaining the borehole integrity.

In addition to the downhole motor assembly 114 and drill bit 116, the BHA 113 also includes one or more drill collars (thick-walled steel pipe) to provide weight and rigidity to aid the drilling process. Some of these drill collars include built-in survey tools 123 to gather measurements of various drilling parameters such as position, orientation, weight-on-bit, borehole diameter, etc. The tool orientation may be specified in terms of a tool face angle (rotational orientation or azimuth), an inclination angle (the slope), and compass direction, each of which can be derived from measurements by magnetometers, inclinometers, and/or accelerometers, though other sensor types such as gyroscopes may alternatively be used. Such orientation measurements along with gyroscopic measurements, inertial measurements, and/or other measurements can be used to accurately track tool position. The survey tools 123 also may gather information regarding formation properties, fluid flow rates, temperature, and other parameters of interest.

The measurements collected by survey tools 123 are conveyed to a control sub 122 for storage in internal memory and later retrieval when the bottom-hole assembly 113 is removed from the borehole 112. The control sub 122 may also include a modem or other communication interface for communicating at least some of the gathered measurements to earth's surface while drilling. For example, the control sub 122 may communicate uphole data to surface interface 124 and/or receive downhole data (survey or drilling commands) from surface interface 124. Various types of telemetry may be suitable for use in the disclosed system, including mud pulse telemetry, acoustic wave telemetry, wired drill pipe telemetry, and electromagnetic telemetry.

At earth's surface, a computer 126 (shown in FIG. 1 in the form of a tablet computer) communicates with surface interface 124 via a wired or wireless network communications link 128, and provides a graphical user interface (GUI) or other form of user interface that enables a user to review received telemetry data (e.g., derived logs, charts, or images) and to direct various drilling and/or survey options. The computer 126 can take alternative forms, including a desktop computer, a laptop computer, a networked computer or processing center (e.g., accessible via the Internet), and any combination of the foregoing. While drilling, a pressure differential can be detected based on measurements gathered from downhole sensors (e.g., in survey tools 123) and/or surface sensors, resulting in a notification or alert being presented to a drilling operator (e.g., via computer 126). In response to the pressure differential alert, a drilling operator may select a drilling fluid with a different density, adjust a drilling fluid pressure, and/or perform other operations to maintain the integrity of the borehole 112. Further, the drilling operator may extend the borehole 112 into or past the pressure differential by some distance. As needed, the pressure differential in the borehole 112 can be dealt with by drilling a relief well 130.

To guide drilling of the relief well 130, one or more magnetic rare earth alloy markers 30 are deployed in the borehole 112. For example, in the drilling environment of FIG. 1, the borehole 112 is shown to have a cased section 20 and an uncased section 24. The cased section corresponds to a casing string 121 having a plurality of individual casing segments 21 connected together by couplers (casing collars) 22. The bottommost casing segment 21 of casing string 121 is known as a casing shoe 23, where the casing terminus for cased section 20 corresponds to a point along or near the casing shoe 23. In at least some embodiments, a magnetic rare earth alloy marker 30 is included with the casing shoe 23 or with another casing segment 21 to facilitate passive ranging as needed (e.g., to guide a relief well to a position along uncased section 24). If the borehole 112 were to include multiple cased sections 20, each section could include one or more magnetic rare earth alloy markers 30 (it is typical for boreholes to be drilled and cased in stages, with each successive stage having a borehole and casing string of a reduced diameter relative to the previous stages). Casing segments with magnetic rare earth alloy markers 30 are deployed in the borehole 112 before a pressure differential occurs. Additionally or alternatively, a magnetic rare earth alloy marker 30 may be deposited or dispensed at the borehole terminus 52 prior to tripping out of the hole, as this is frequently when a pressure differential, leading to a hydrocarbon kick, occurs. Additionally or alternatively, a magnetic rare earth alloy marker 30 may be dispensed along at least a portion of annulus 119 before or after a pressure differential occurs.

To extend the relief well 130 to a desired position relative to the borehole 112, a BHA 132 in the relief well 130 may include a magnetic field sensing tool 140 (e.g., a ranging tool), a control sub 142, a directional drilling system 144, and a drill bit 146. Drilling of the relief well 130 by the BHA 132 is directed, for example, from a drilling platform similar to the one described previously. In at least some embodiments, the magnetic field sensing tool 140 employs multi-axis magnetic field sensors to perform repeated measurements whereby the distance and/or direction to one or more magnetic rare earth alloy markers 30 is estimated and used to guide the drill bit 146 to intersect (usually at a shallow angle) and establish hydraulic communications with the borehole 112. The magnetic field sensing tool 140 may take any suitable form, including flux-gate magnetometers and atomic magnetometers, both of which generally exhibit high and/or directional sensitivity. Moreover, multiple such magnetometers may be combined to form magnetic gradiometers with multi-axis sensitivity. Once the relief well 130 intersects the borehole 112 at a desired position relative to the one or more magnetic rare earth alloy markers 30, a high-density "kill" fluid may be injected from the relief well 130 into the borehole 112 to suppress the hydrocarbon influx. While the formation pressure is under control, another cased section 20 may be added to the borehole 112, extended past the pressure differential zone. Further inflows of formation fluid may then be introduced to re-establish control of the fluid flows in the borehole 112.

It should be appreciated that the borehole of the target well 112 and the relief well 130 may be drilled using any suitable drilling technique. Example drilling techniques include rotary, rotary steerable, steerable downhole motors, percussive drilling tools, coiled tubing, turbines, jetting techniques, other bit rotation devices, or any combination thereof. Jointed pipe, coiled tubing, drill pipe, composite or aluminum drill pipe, or any combination thereof, may be used to drill a borehole. Example drill bits include roller cone drill bit or polycrystalline diamond compact (PDC) drill bits. In different embodiments, deployment of a magnetic rare earth alloy marker 30 at the borehole terminus 52 may involve use of standard or modified drilling components. Further, casing segments 21 with magnetic rare earth alloy markers 30 may correspond to standard segments, where the at least one magnetic rare earth alloy markers 30 are simply attached before the segment is lowered into the borehole 112. Alternatively, casing segments 21 with at least one magnetic rare earth alloy markers 30 may correspond to modified segments, where options for attaching, covering, and/or protecting magnetic rare earth alloy markers 30 involve modifying a casing segment for use with magnetic rare earth alloy markers 30.

Figure 2:
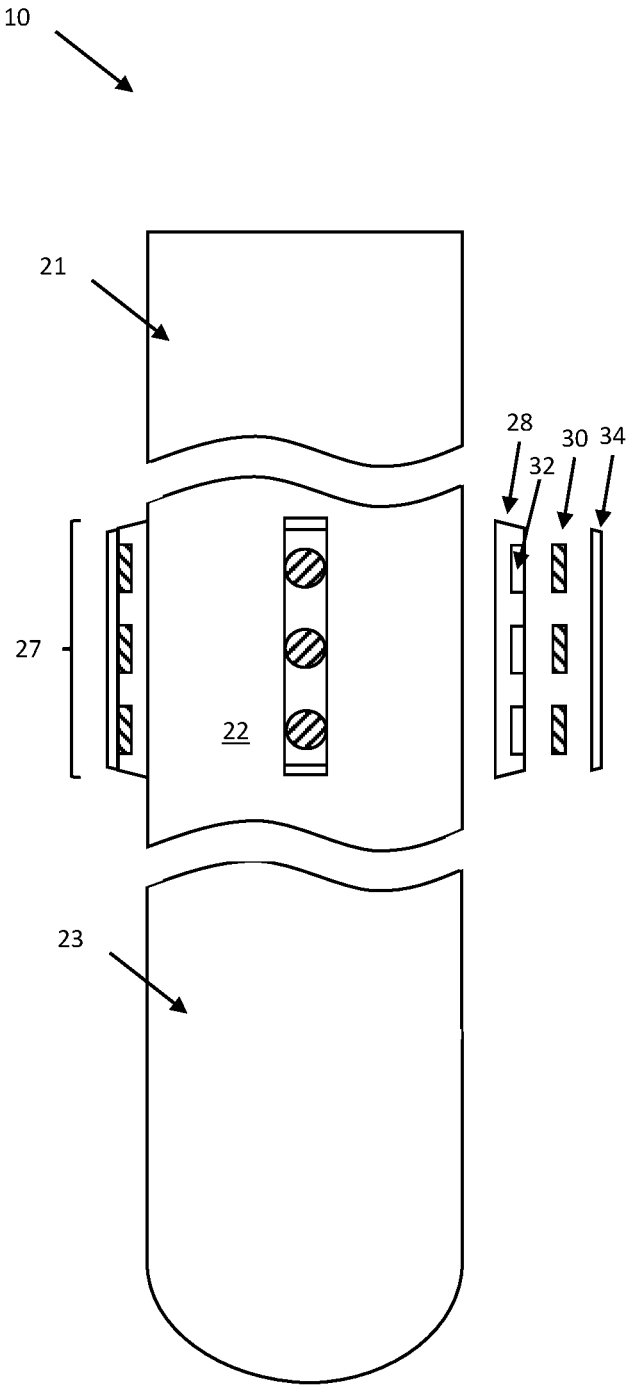
FIG. 2 is a schematic diagram of an illustrative magnetic rare earth alloy marker arrangement for a casing string.

FIG. 2 shows a schematic diagram of a magnetic rare earth alloy marker arrangement 10 for a casing string. For the arrangement 10, a casing segment 21, a casing shoe 23, and a guard flange assembly 27 are represented. The guard flange assembly 27 may be part of casing segment 21 or casing shoe 23 and provides a desired level of gap control and/or protection between a cased section of a borehole and a borehole wall or between two cased sections of a borehole. In at least some embodiments, the guard flange assembly 27 comprises at least one guard flange 28 extending longitudinally along an exterior surface 22 of casing segment 21 or casing shoe 23. Each guard flange 28 includes one or more recesses 32 to embed at least one magnetic rare earth alloy markers 30 therein. Further, a cover 34 may be applied over embedded markers 30 for protection from the harsh downhole environment. Without limitation, each guard flange 28 may be attached to a casing segment 21 or casing shoe 23 by welds, screws, bolts, adhesives, and/or other known attachment techniques. Further, markers 30 may be embedded in each guard flange 28 using screws, bolts, adhesives, a friction fit, and/or other known attachment techniques including employing lips, threads, catches, or other mating interfaces (recesses or raised surfaces) along a surface of markers 30 and casing shoe 23. The cover 34 may be made of, but is not limited to, plastic, metal, or epoxy.

Figure 3A:
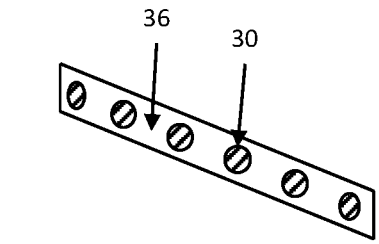
FIGS. 3A and 3B are schematic diagrams showing an alternative magnetic rare earth alloy marker arrangement for a casing string.
Figure 3B:
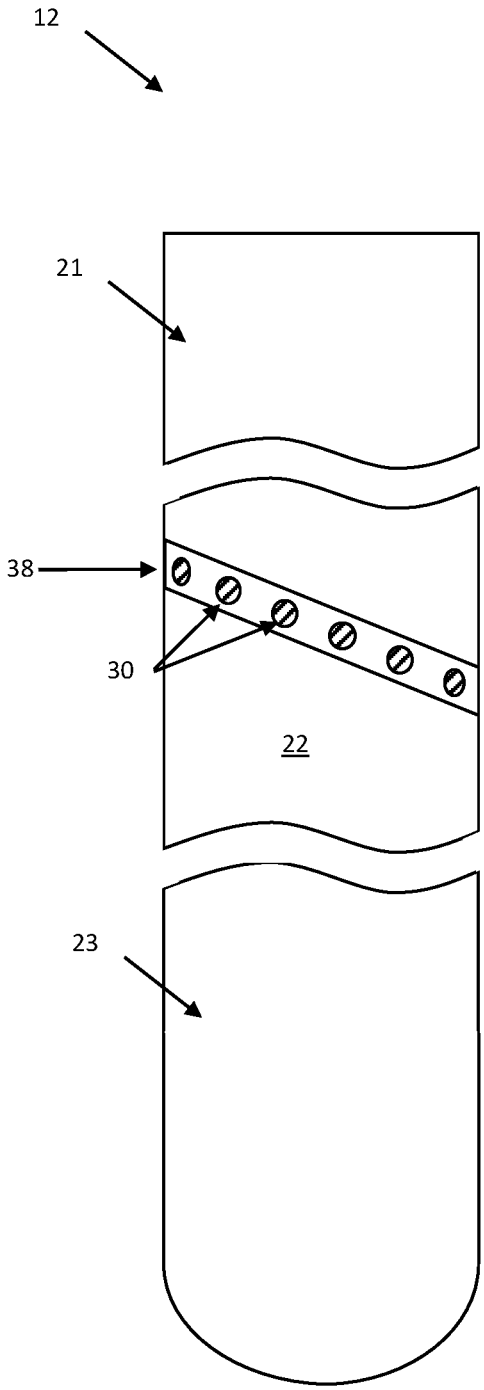

FIGS. 3A and 3B are schematic diagrams showing another magnetic rare earth alloy marker arrangement 12 for a casing string. In FIG. 3A, a strap or retainer assembly 38 including at least one magnetic rare earth alloy markers 30 attached to a strap 36 is represented. Without limitation, the magnetic rare earth alloy markers 30 are attached to strap 36 using known attachment techniques including, but not limited to, a friction fit, screws, bolts, or adhesives. Alternatively, the marker 30 may be sandwiched between two separate straps 36. The strap 36 may comprise, for example, a flexible metal material that resists corrosion in the downhole environment. Alternatively, the strap 36 may comprise a rigid material that protects the magnetic rare earth alloy markers 30 from abrasion, etc. Further, the strap 36 may include a tightening, locking, or latching mechanism to facilitate fastening the strap 36 to a tubular. In different embodiments, the strap 36 corresponds to a one piece strap or a multi-piece strap (e.g., hinged pieces may be used).

As seen in FIG. 3B, the magnetic rare earth alloy marker arrangement 12 corresponds to the strap assembly 38 represented in FIG. 3A attached to an outer surface 22 of a casing segment 21 or casing shoe 23. The particular mechanism for attaching the strap assembly 38 around casing segment 21 or casing shoe 23 may include, for example, welds, screws, bolts, or adhesive.

Another option for deploying magnetic rare earth alloy markers 30 in a borehole involves mixing an unconsolidated mass of magnetic rare earth alloy markers 30 (e.g., small pieces or powder) with a suspension fluid and dispensing the suspension fluid in a flow stream that passes through a cased section (e.g., cased section 20) into the borehole. The flow stream may correspond to a drilling fluid, a cement slurry, or another suspension fluid that includes an unconsolidated mass of markers 30. In at least some embodiments, an unconsolidated mass of markers 30 mixed with a suspension fluid correspond to substantially spherical particles or pieces in order to facilitate flow of the markers 30 to the borehole terminus 52. Further, in at least some embodiments, an unconsolidated mass of markers 30 should be dense enough to settle once the borehole terminus 52 is reached, thus providing a fixed position for markers 30 at the borehole terminus 52. In at least some embodiments, an unconsolidated mass of markers 30 may be part of a suspension fluid that hardens or cures over time, thereby ensuring that at least some markers 30 remain permanently at a borehole terminus 52.

Figure 4A:
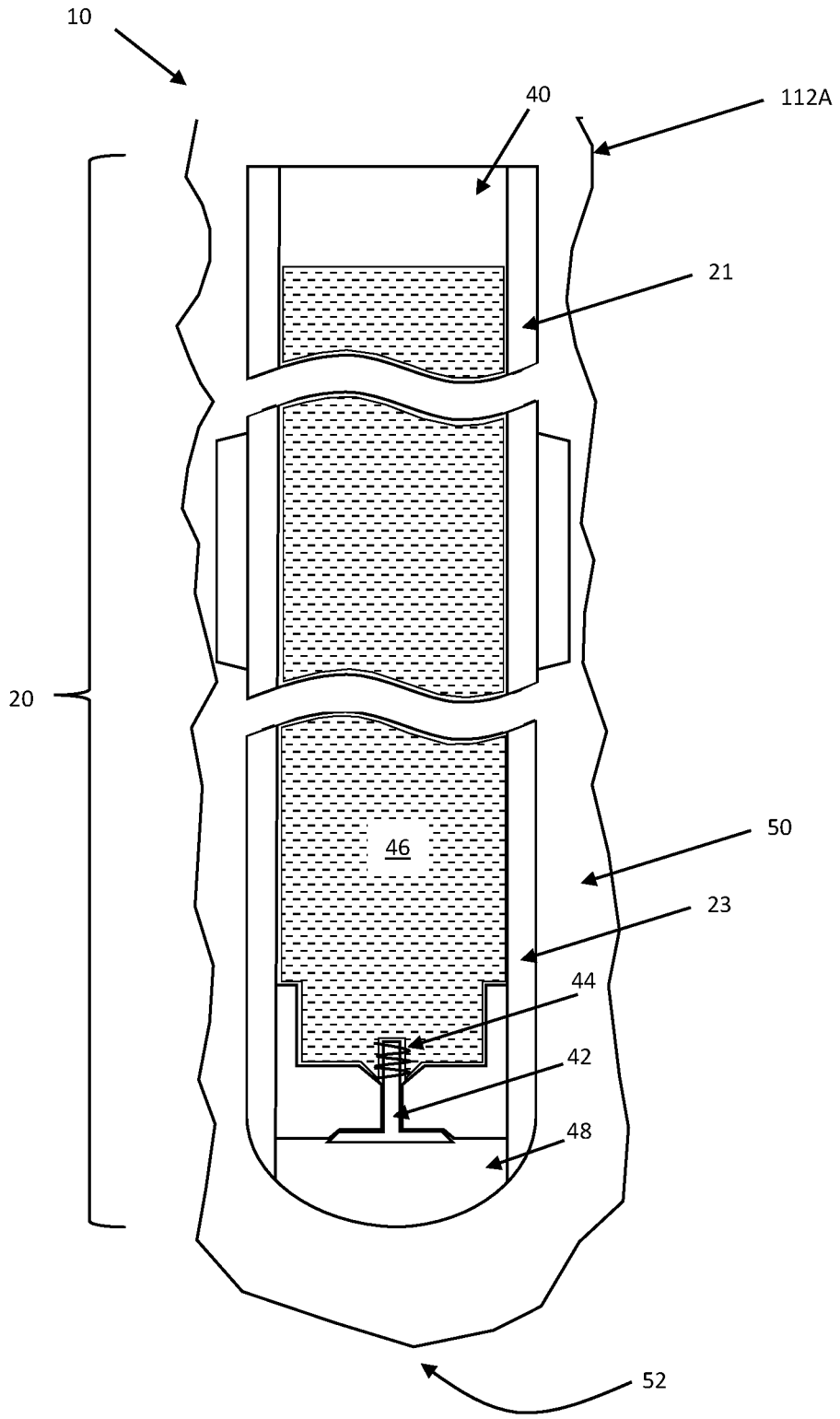
FIGS. 4A and 4B are transverse cross-sectional views showing a magnetic rare earth alloy marker mass dispensed into a borehole via a casing string.
Figure 4B:
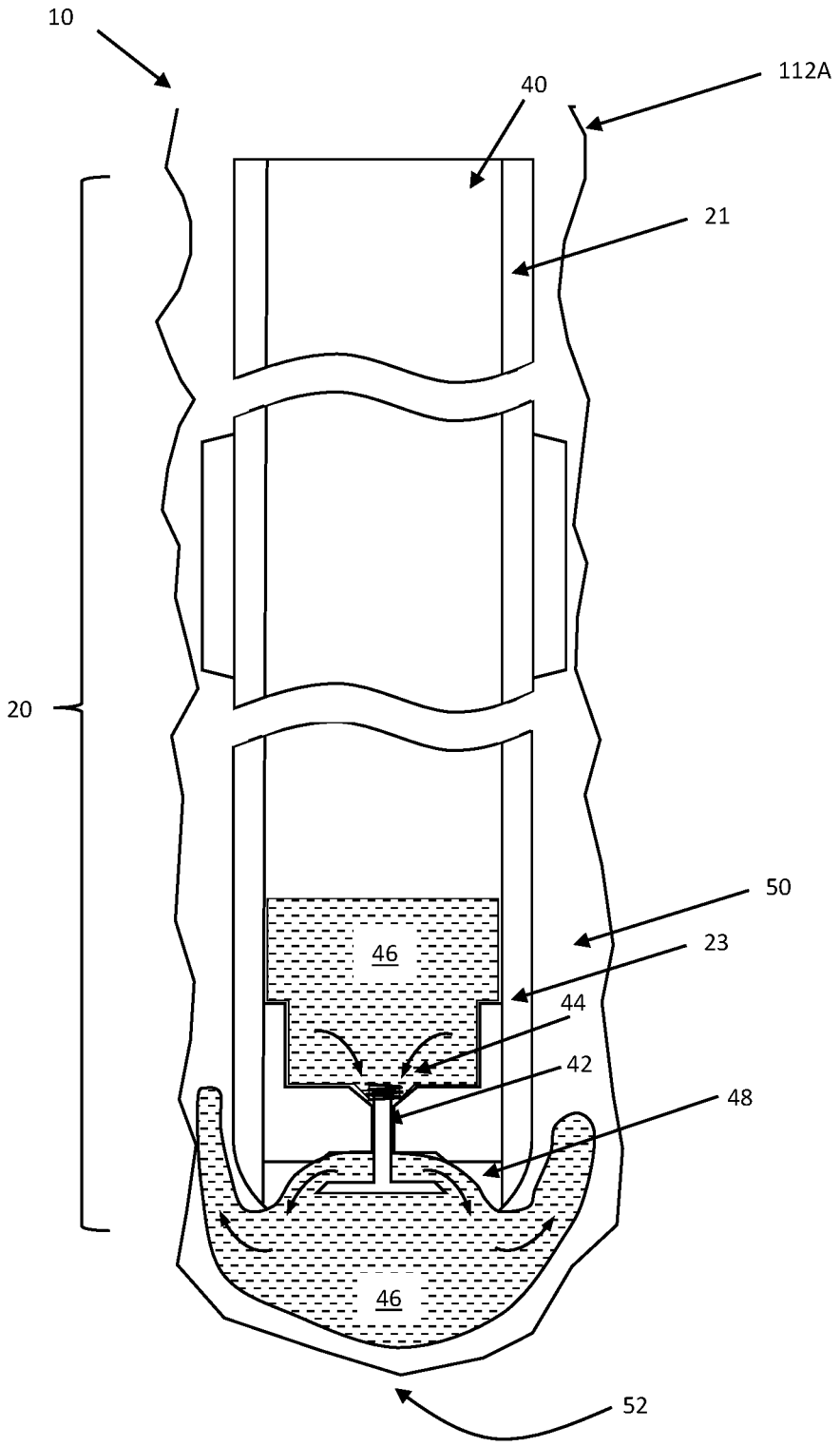

FIGS. 4A and 4B show an example of dispensing an unconsolidated mass 46 having markers 30 into a borehole 112A. In some embodiments, the unconsolidated mass 46 may be distributed in all the drilling fluid or cement slurry being pumped. Alternatively, the unconsolidated mass 46 may be part of a distinct "slug" that is introduced into a fluid being pumped. The slug may correspond to a suspension fluid with the unconsolidated mass 46. Rather than being dissolved by the fluid into which it is introduced, the slug occupies a space along a fluid column that is being pumped through a casing. Alternatively, the unconsolidated mass 46 may be part of a "pill" that encapsulates or otherwise facilitates conveyance of the unconsolidated mass 44. The pill may be conveyed downhole as part of a slug or may be introduced directly into a flow stream.

In FIG. 4A, a suspension fluid with unconsolidated marker mass 46 resides in an inner chamber 40 of a cased section 20 for borehole 112A including casing segments 21 and a casing shoe 23. The casing shoe 23 includes a one-way valve 42, a spring 44, and a release cavity 48. Further, the casing segments 21 or casing shoe 23 may include guard flanges with or without magnetic rare earth alloy markers 30 (see e.g., FIG. 2). In at least some embodiments, the casing shoe 23 prevents fluid flow through one-way valve 42 until a pressure of the suspension fluid with unconsolidated marker mass 46 exceeds a threshold. Thereafter, the suspension fluid with unconsolidated marker mass 46 flows from the inner chamber 40 into an annulus 50 between cased section 20 and a borehole wall as well as any space between the cased section 20 and the borehole terminus 52 of borehole 112A as shown in FIG. 4B.

In the example of FIGS. 4A and 4B, depositing the unconsolidated marker mass 46 at the borehole terminus 52 replaces or supplements magnetic rare earth alloy markers 30 associated with cased section 20.In FIG. 4A, the unconsolidated marker mass 46 is initially suspended in the inner chamber 40 as part of a cement slurry that can be pumped out into the borehole 112A. Once the cement slurry has been pumped out of the inner chamber 40, the pressure applied to the fluid in the cased section 20 may be reduced resulting in the cement slurry staying in the borehole 112A. The one-way valve 42 prevents back flow of the unconsolidated marker mass 46 into the inner chamber 40 once the unconsolidated marker mass 46 has been dispensed. Once the cement slurry has dried, the small pieces of unconsolidated marker mass 46 that were mixed with the cement slurry are still usable to guide passive ranging operations as described herein. The dried cement also serves to stabilize the cased section 20. To further extend the borehole 112A, a drill string may drill through the casing shoe 23 and any dried cement present below the casing shoe 23. Even so, dried cement along the annulus 50 will remain and can be used as a magnetic rare earth alloy marker.

Additionally or alternatively to deploying magnetic rare earth alloy markers along a cased section as described previously, FIGS. 5A and 5B show an unconsolidated marker mass 46 dispensed into an uncased section 24 of a borehole 112B. The unconsolidated marker mass 46 may take the form of a suspension fluid containing magnetic marker particles, a suspension fluid containing magnetic marker powder, a suspension fluid containing small magnetic marker shapes, or a plurality of individual magnetic marker pieces and shapes including spheres (see e.g., FIGS. 7A-7F). In at least some embodiments, the marker mass 46 is dispensed into the uncased section 24 as part of a fluid flow that passes through a drill string 108 that has extended the borehole 112B past cased section 20 by an amount corresponding to the uncased section 24.

Figure 5A:
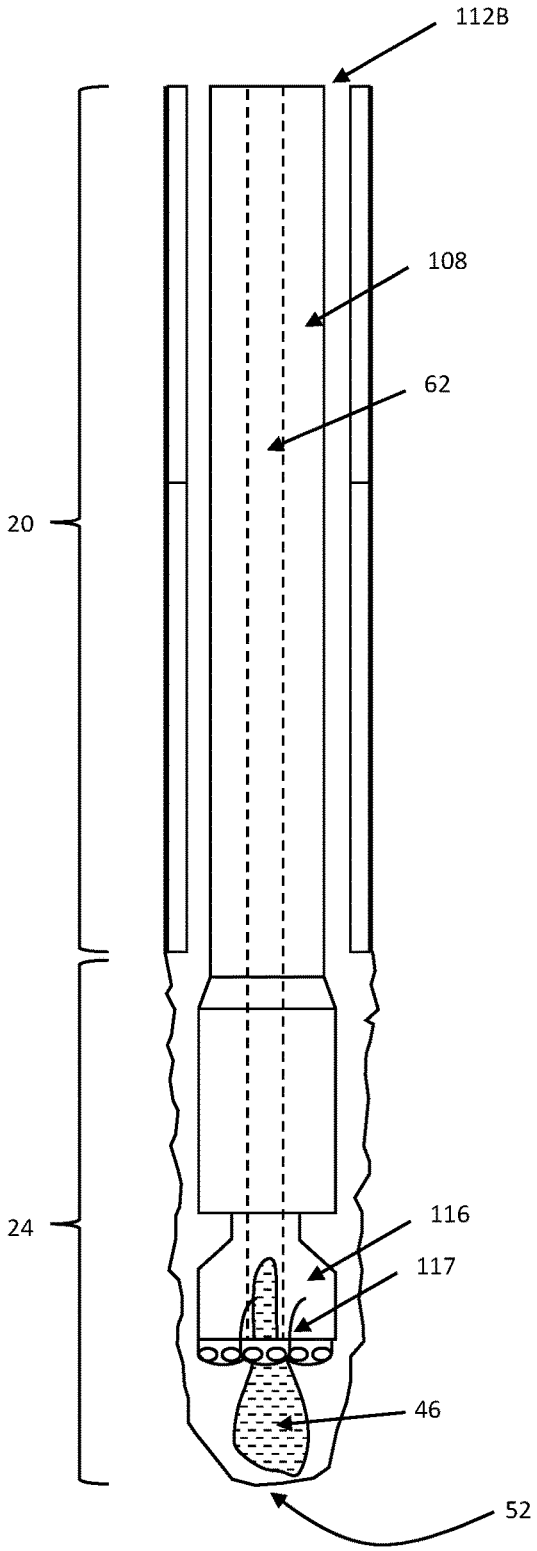
FIGS. 5A and 5B are transverse cross-sectional views showing a magnetic rare earth alloy marker mass dispensed into a borehole via a drill string.
Figure 5B:
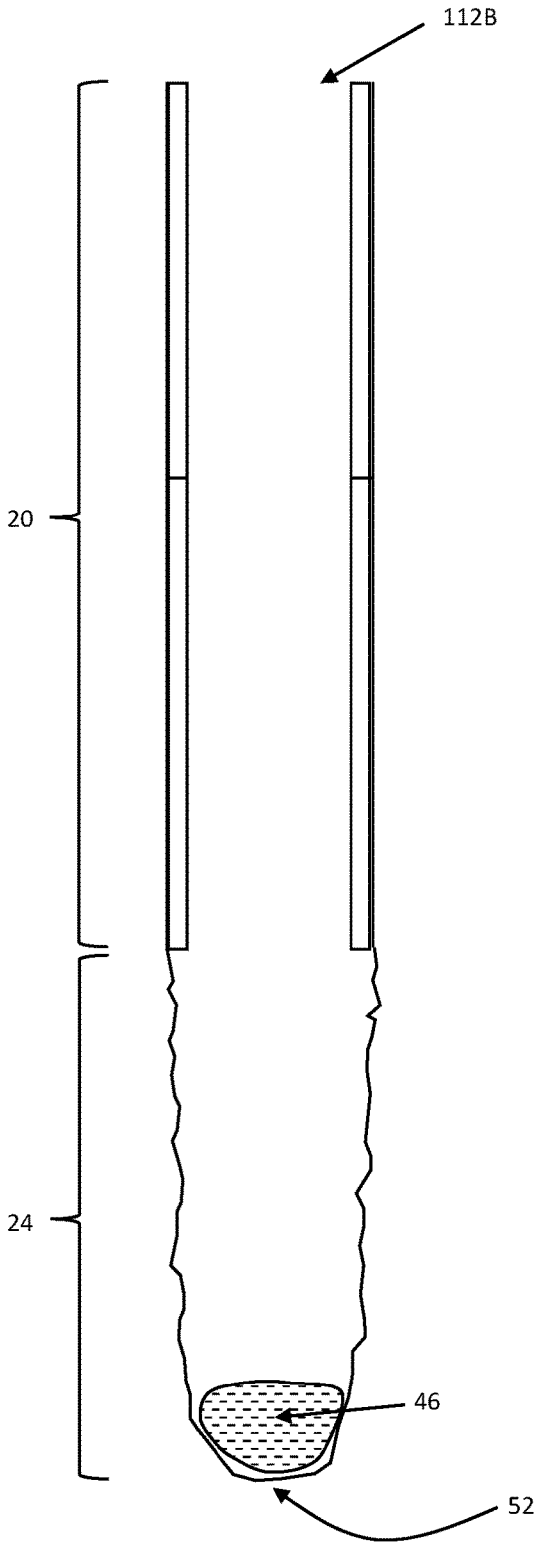

In the scenario of FIGS. 5A and 5B, a pressure differential has occurred, and the borehole 112B has been extended into or past the pressure differential by some distance. At this point, the unconsolidated marker mass 46 is pumped through a hollow region 62 of drill string 108 and out into the borehole 112B via at least one nozzle 117 or another opening in drill bit 116. The unconsolidated marker mass 46 stays at the borehole terminus 52 of borehole 112B even if the drill string 108 is removed as shown in FIG. 5B. In different embodiments, the unconsolidated marker mass 46 is suspended in a drilling fluid or a cement slurry. Further, in at least some embodiments, the unconsolidated marker mass 46 includes a binding agent that causes the unconsolidated marker mass 46 to adhere to the borehole terminus 52 of borehole 112B even if a pressure differential causes fluid flow in the borehole above 112B. Further, the unconsolidated marker mass 46 may dry, cure, or otherwise harden once it has been deposited into the borehole 112B.

Figure 6:
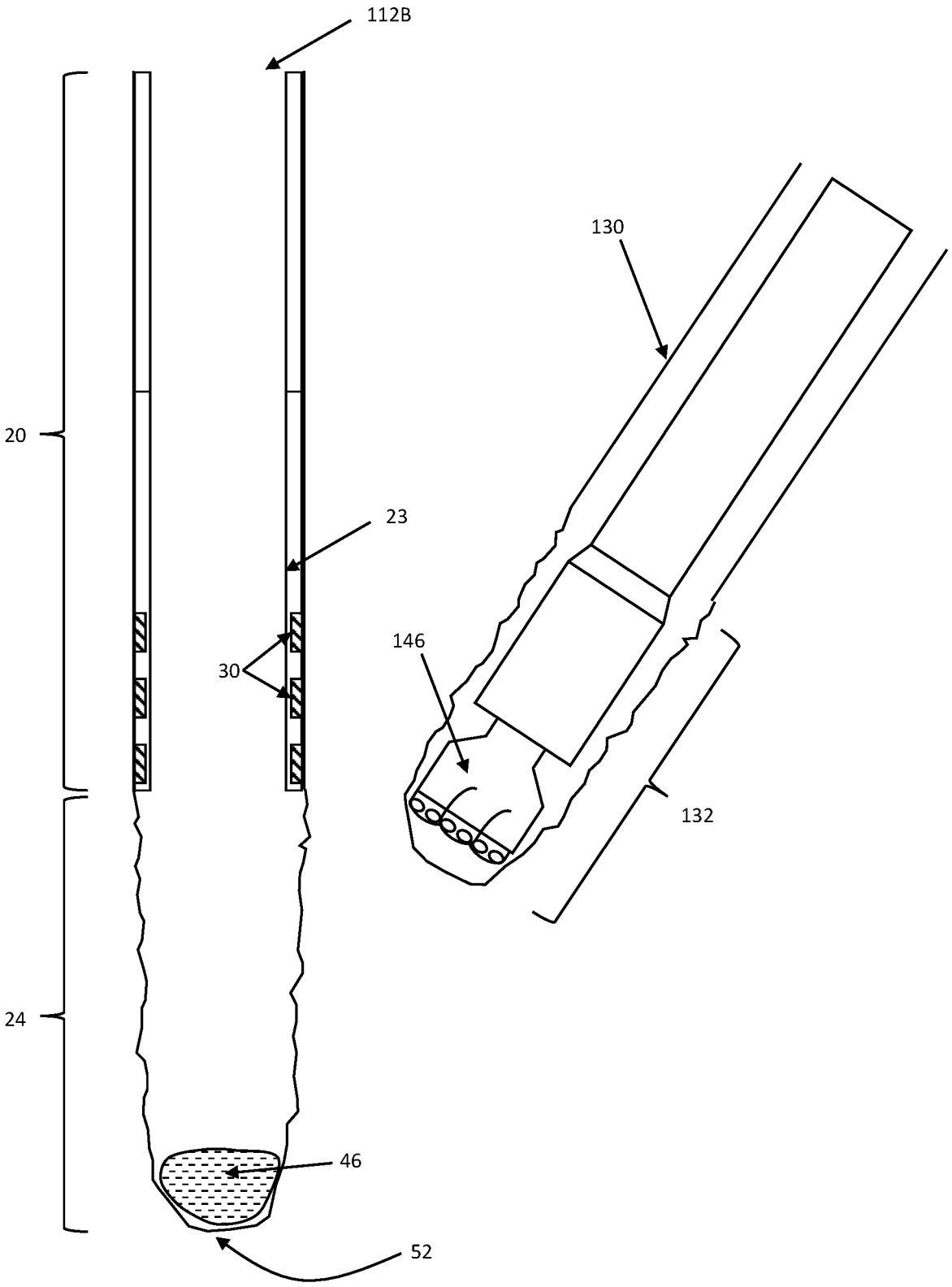
FIG. 6 is a schematic diagram showing an illustrative use of magnetic rare earth alloy markers to guide drilling of a relief well.

With or without the drill string 108 removed, the unconsolidated marker mass 46 (or a corresponding hardened material) at the borehole terminus 52 of borehole 112B can be used to guide a drill bit 146 of a BHA 132 in the relief well 130 to a desired position along the uncased section 24 of borehole 112B as shown in FIG. 6. The desired intersection position relative to one or more magnetic rare earth alloy markers may be determined using predetermined information regarding the total depth of the borehole 112B, a predetermined length of cased section 20, a predetermined length of uncased section 24, and/or the estimated location of the hydrocarbon influx relative to the borehole terminus 52, the cased section 20, or a coordinate position. The cased section 20 and any magnetic rare earth alloy markers 30 included along the cased section 20 may additionally or alternatively be used to guide the relief well 130 to a desired position along the uncased section 24. In particular, magnetic rare earth alloy markers 30 included near the bottom of cased section 20 (e.g., in casing shoe 23) would be helpful, especially as the length of uncased section 24 increases. Once the relief well 130 intersects the borehole 112B, the pressure differential can be controlled and another cased section 20 can be added and/or cementing can be performed to prevent further issues due to the pressure differential that necessitated the drilling of relief well 130.

Figure 7A:
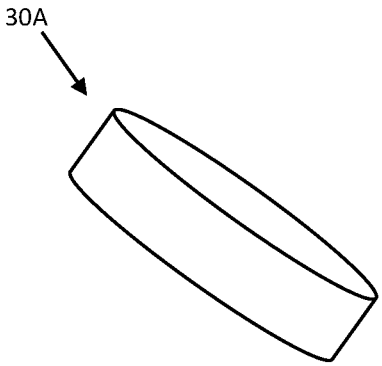
FIGS. 7A-7F are perspective views showing illustrative magnetic rare earth alloy marker shapes.
Figure 7B:
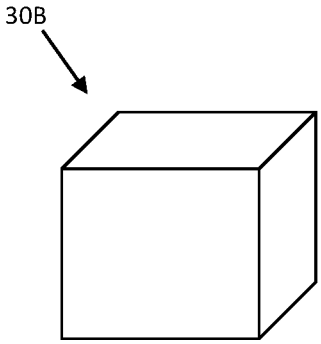
Figure 7C:
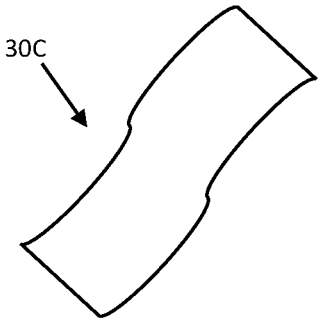
Figure 7D:
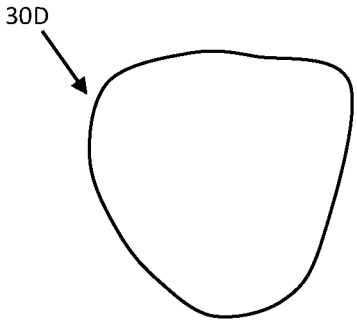
Figure 7E:
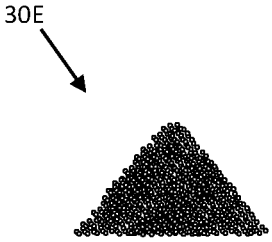
Figure 7F:
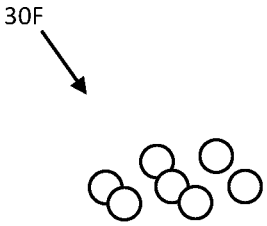

FIGS. 7A-7F shows some examples of various shapes for the magnetic rare earth alloy markers 30. In FIG. 7A, marker 30A corresponds to a disk shape. In FIG. 7B, marker 30B corresponds to a cube or box shape. In FIG. 7C, marker 30C corresponds to a ribbon. In FIG. 7D, marker 30D corresponds to an unconsolidated marker mass 46 in the form of a suspension fluid with small marker components. In FIG. 7E, marker 30E corresponds to a granular powder shape (e.g., such powder may include small marker components resulting in an unconsolidated marker mass 46). In FIG. 7F, marker 30F corresponds to a substantially spherical shape. In some embodiments, each of the markers 30A-30F may be encapsulated in a pill such as non-magnetic material (e.g., plastic) to facilitate conveying the markers 30A-30F down a drill string and into a borehole (e.g., boreholes 112A, 112B).

Without limitation to other embodiments, the markers 30A and 30B may correspond to any of the markers 30 attached to a casing section 21 or casing shoe 23 as described herein. Further, the marker 30C may be part of a strap that wraps around a casing section 21 or casing shoe 23 as described herein. Further, the marker 30D may be dispensed from a casing string or drill string as described herein. Likewise, the marker 30E may be part of an unconsolidated marker mass 46 that is dispensed from a casing string or drill string as described herein. Further, the marker 30F may correspond to individual markers that are introduced into the drill string and pushed down the drill string by gravity and/or mud fluid pressure for placement in the borehole terminus 52. Alternatively, small versions of marker 30F may be part of an unconsolidated marker mass 46 dispensed from a casing string or drill string as described herein. Other marker shapes and marker deployment techniques are possible and are limited only by commercial manufacturing processes, project budgets, and the specific needs of the application on hand.

In at least some embodiments, the materials used for magnetic rare earth alloy markers (e.g., markers 30 and 30A-30F) may be selected to resist becoming demagnetized in high temperature boreholes. Further, the materials and arrangement of magnetic rare earth alloy markers may be selected to facilitate distinguishing magnetic fields emanating from one or more magnetic rare earth alloy markers from earth's magnetic field. Example magnetic rare earth alloy markers are made from a combination of neodymium, iron, and boron and are known as NdFeB and NIB magnets. Further, in at least some embodiments, magnetic rare earth alloy markers comprise neodymium alloyed with at least one of terbium and dysprosium.

NdFeB magnets have desirable properties of high remanence ($B_r$), where a strong magnetic field is produced that can be detected by passive ranging tools at distances exceeding those expected from remnant ferromagnetism from the casing shoe material; a high density of magnetic energy ($BH_{max}$), considerably more than samarium cobalt (SmCo) magnets; and to ensure that magnetization exists for as long as possible, the material also has a high coercivity ($H_{ci}$).

When deployed in a suspension fluid as in FIGS. 4A, 4B, 5A, 5B and 6, magnetic rare earth alloy markers may correspond to an unconsolidated marker mass 46 designed to be left at the borehole terminus of a borehole given the flow rate and geometry of the borehole. Such deployment may involve pumping the unconsolidated marker mass 46 through a casing as described herein, or employing another conveyance technique such as bullheading the unconsolidated marker mass 46 or a corresponding pill down the casing string to ensure it reaches and stays at the borehole terminus. In at least some embodiments, deployment of an unconsolidated marker mass 46 also involves use of protective coatings (e.g., nickel plating, two-layered copper-nickel plating, or other metals), polymers, or lacquers in the mixing and/or pumping process.

Figure 8:
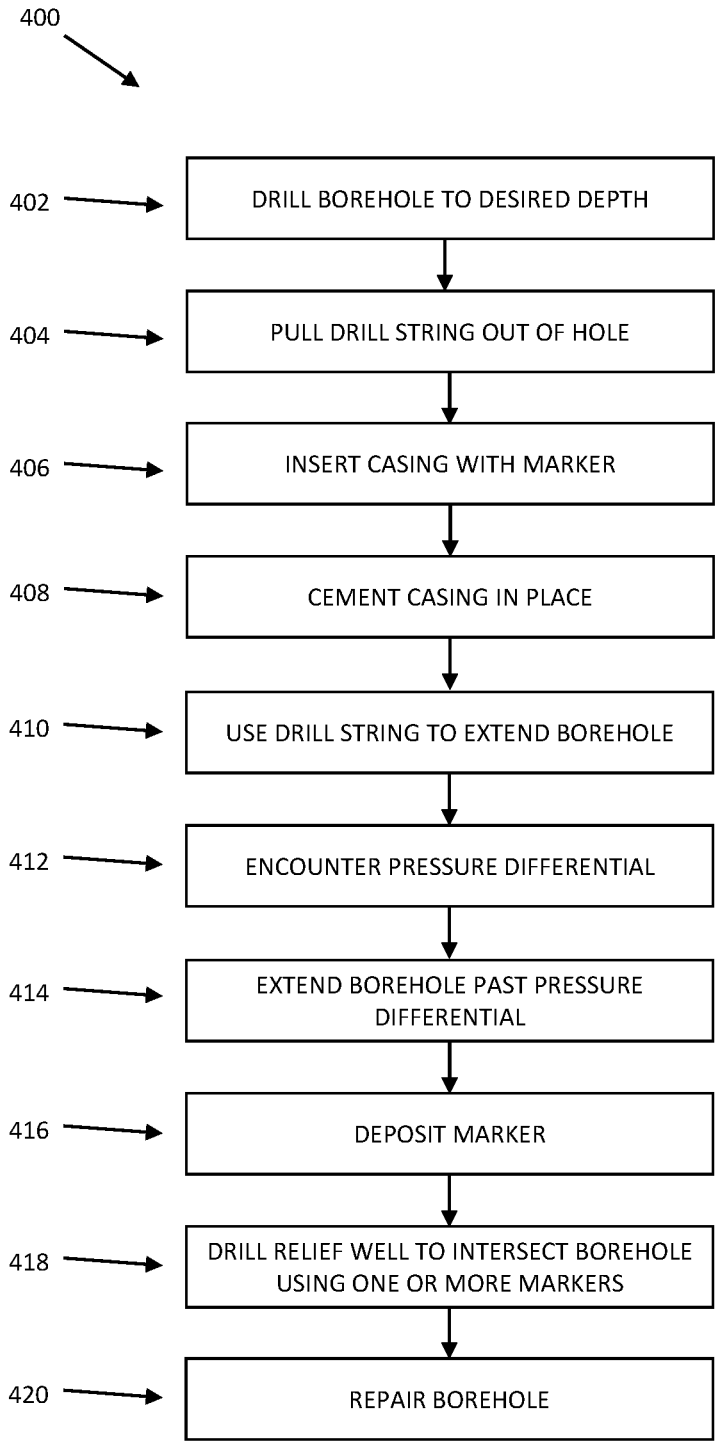
FIG. 8 is a flowchart showing a method involving use of magnetic rare earth alloy markers in a borehole.

FIG. 8 shows a flowchart showing a method 400 for using magnetic rare earth alloy markers in a borehole. At block 402, a drilling crew uses a drill string to extend a borehole to a desired depth. At block 404, once the drill string has reached the desired depth, drilling is halted and the drill string is pulled out of the borehole. At block 406, casing segments are inserted into the borehole. In at least some embodiments, a predetermined casing segment, such as the bottommost casing segment (the casing shoe), includes at least one magnetic rare earth alloy marker 30 as described herein.

At block 408, the deployed cased section is cemented in place. The cementing process represents another opportunity to deploy a magnetic rare earth alloy marker in the form of a fluid cement slurry as described herein. At block 410, the drill string extends the borehole past the cased section. At block 412, a pressure differential is encountered (e.g., an uncontrolled hydrocarbon influx). At block 414, the drill string extends the borehole into or past the pressure differential by some distance. At block 416, a magnetic rare earth alloy marker is deposited at the borehole terminus. For example, the magnetic rare earth alloy marker deposited at the borehole terminus may correspond to a marker mass, slug, pill, or marker fluid dispensed via a drill string as described herein. At block 418, a relief well is drilled to intersect a position along the uncased section of the borehole using one or more of the magnetic rare earth alloy markers previously deployed in the borehole. At block 420, the borehole is repaired as described herein. As needed, additional borehole sections are drilled, casing segments are added, magnetic rare earth alloy markers are deployed, and relief wells are drilled using the markers.

Embodiments disclosed herein include:

A: A magnetic marking method that comprises drilling a borehole and marking a position at or beyond a casing terminus of the borehole with a magnetic rare earth alloy marker.

B: A borehole intersection method that comprises obtaining target borehole parameters including at least one magnetic marker's estimated position along the target borehole, the at least one magnetic marker comprising a magnetic rare earth alloy. The method also comprises drilling a relief borehole to intersect the target borehole at an intersection point selected relative to the at least one magnetic marker's estimated position. Drilling the relief well includes sensing a magnetic field from the at least one magnetic marker and, based at least in part on the magnetic field, directing a steerable drilling assembly toward the intersection point.

C: A magnetic marker for a casing terminus, the marker comprising a marker comprising a magnetic rare earth alloy and an attachment mechanism that secures the magnet to a casing terminus.

D: A magnetic marker for open hole use using a mass of magnetic rare earth alloy and a suspension fluid for conveying the magnetic material through a drill string into an open borehole.

Each of embodiments A, B, C, and D may have one or more of the following additional elements in any combination: Element 1: wherein said position is the casing terminus, and said marking comprises attaching the marker to a casing shoe. Element 2: wherein said attaching is performed before lowering the casing shoe into the borehole. Element 3: wherein said attaching comprises embedding the marker in a recess on an exterior surface of the casing shoe. Element 4: wherein said attaching comprises strapping the marker to an exterior surface of the casing shoe. Element 5: wherein said marking comprises conveying the marker to said position using a flow stream and wherein the position is within an uncased section of the borehole. Element 6: wherein the flow stream comprises a cement slurry and wherein the position is a casing terminus. Element 7: wherein said flow stream flows through an interior of a drill string. Element 8: wherein said position is a borehole terminus. Element 9: wherein the magnetic rare earth alloy comprises neodymium, iron, and boron. Element 10: wherein the magnetic rare earth alloy comprises neodymium alloyed with at least one of terbium and dysprosium.

Element 11: wherein the estimated position is a casing terminus. Element 12: wherein the estimated position is a borehole terminus. Element 13: wherein the intersection point is selected to be the estimated position. Element 14: wherein the target borehole parameters include a plurality of estimated positions for a corresponding plurality of magnetic markers.

Element 15: wherein the attachment mechanism comprises a lip, thread, or catch that mates with a recess in the casing terminus. Element 16: wherein the attachment mechanism comprises a strap or retainer that holds the marker against an external surface of the casing shoe.

Element 17: wherein the fluid renders the magnetic marker dense enough to settle and remain at a borehole terminus. Element 18: wherein the fluid comprises cement or another settable material that causes the magnetic marker to harden or cure in place. Element 19: wherein the magnetized material comprises substantially spherical particles.

Numerous variations and modifications will become apparent to those skilled in the art once the above disclosure is fully appreciated. For example, the figures show system configurations suitable for production monitoring, but they are also readily usable for monitoring treatment operations, cementing operations, active and passive seismic surveys, and reservoir and field activity monitoring. It is intended that the following claims be interpreted to embrace all such variations and modifications.

What is claimed is:

1. A magnetic marking method that comprises:

drilling a borehole; and marking a position at a borehole terminus of the borehole with an unconsolidated marker mass comprising a magnetic rare earth alloy, wherein said marking comprises conveying the unconsolidated marker mass to the position at the borehole terminus using a flow stream and wherein the position is within an uncased section of the borehole.

2. The method of claim 1, wherein marking further comprises marking a location at a casing terminus of a casing located within the borehole, and wherein said marking of the location of the casing terminus comprises attaching a passive magnetic marker comprising a magnetic rare earth alloy to a casing shoe of the casing.

3. The method of claim 2, wherein said attaching is performed before lowering the casing shoe into the borehole.

4. The method of claim 3, wherein said attaching comprises embedding the passive magnetic marker in a recess on an exterior surface of the casing shoe.

5. The method of claim 3, wherein said attaching comprises strapping the passive magnetic marker to an exterior surface of the casing shoe.

6. The method of claim 1, wherein said marking with the unconsolidated marker mass comprises conveying a slug comprising the magnetic rare earth alloy to the position at the borehole terminus using the flow stream.

7. The method of claim 1, wherein the flow stream comprises a cement slurry.

8. The method of claim 1, wherein said flow stream flows through an interior of a drill string.

9. The method of claim 8, wherein said marking of the position at the borehole terminus facilitates a passive ranging operation to guide a relief well to an intersection position along the uncased section of the borehole.

10. The method of claim 1, wherein the magnetic rare earth alloy comprises neodymium, iron, and boron.

11. The method of claim 1, wherein the magnetic rare earth alloy comprises neodymium alloyed with at least one of terbium and dysprosium.

12. A borehole intersection method that comprises:

obtaining target borehole parameters for a target borehole including at least one passive magnetic marker's estimated position along the target borehole, said at least one passive magnetic marker comprising an unconsolidated maker mass comprising a magnetic rare earth alloy and positioned at a borehole terminus of the target borehole; and drilling a relief borehole to intersect the target borehole at an intersection point selected relative to the at least one magnetic marker's estimated position, where said drilling includes:

sensing a magnetic field from the at least one magnetic marker; and based at least in part on the magnetic field, directing a steerable drilling assembly toward the intersection point along an uncased portion of the target borehole.

13. The method of claim 12, wherein the estimated position is beyond a casing terminus of a cased portion of the borehole.

14. The method of claim 12, wherein the intersection point is selected to be the estimated position.

15. The method of claim 12, wherein the target borehole parameters include a plurality of estimated positions for a corresponding plurality of passive magnetic markers.

16. The method of claim 15, wherein at least one of the plurality markers positioned at a casing terminus along a cased portion of the target borehole.

17. A system for marking positions within a borehole, the system comprising:

one or more passive magnetic markers deployed in a borehole to mark one or more positions within the borehole, wherein at least one of the one or more passive magnetic markers comprises a magnet comprising a magnetic rare earth alloy located at casing terminus of a cased portion of the borehole;

a casing shoe comprising at least one of the one or more passive magnetic markers and positioned to identify a casing terminus of the cased portion of borehole, wherein the at least one of the passive magnetic markers comprises a magnet comprising a magnetic rare earth alloy; and an unconsolidated marker mass positioned to identify a borehole terminus of the borehole, wherein the unconsolidated mass comprises a magnetic rare earth alloy.

18. The marker of claim 17, wherein the at least one passive magnetic marker is attached to the casing shoe of by a lip, a thread, or a catch that mates with a recess in the casing shoe.

19. The marker of claim 17, wherein a strap or a retainer holds the at least one passive magnetic marker located at the casing terminus against an external surface of the casing shoe.

20. A passive magnetic marker for open hole use in a borehole, the passive magnetic marker comprising:

an unconsolidated mass of high remanence, magnetized material that comprises a magnetic rare earth alloy; and a suspension fluid suited for conveying the magnetized material through a drill string bore into the open borehole for marking a position at a borehole terminus of an uncased section of the borehole.

21. The passive magnetic marker of claim 20, wherein the fluid renders the passive magnetic marker dense enough to settle and remain at the borehole terminus.

22. The passive magnetic marker of claim 20, wherein the fluid comprises cement or another settable material that causes the unconsolidated mass to harden or cure in place.

23. The passive magnetic marker of claim 20, wherein the magnetized material comprises spherical particles.

* * * * *